US009195155B2

(12) United States Patent
Zhou et al.

(10) Patent No.: US 9,195,155 B2
(45) Date of Patent: Nov. 24, 2015

(54) TONER PROCESSES

(71) Applicant: XEROX CORPORATION, Norwalk, CT (US)

(72) Inventors: Ke Zhou, Oakville (CA); Guerino G. Sacripante, Oakville (CA); Yulin Wang, Oakville (CA); Abdisamed Sheik-Qasim, Etobicoke (CA); Rashid Mahmood, Mississauga (CA); Rosa Duque, Brampton (CA)

(73) Assignee: XEROX CORPORATION, Norwalk, CT (US)

( * ) Notice: Subject to any disclaimer, the term of this patent is extended or adjusted under 35 U.S.C. 154(b) by 31 days.

(21) Appl. No.: 14/047,426

(22) Filed: Oct. 7, 2013

(65) Prior Publication Data

US 2015/0099226 A1 Apr. 9, 2015

(51) Int. Cl.

| | |
|---|---|
| ***G03G 9/087*** | (2006.01) |
| ***G03G 9/08*** | (2006.01) |
| ***G03G 9/093*** | (2006.01) |

(52) U.S. Cl.

CPC ..... *G03G 9/0804* (2013.01); *G03G 9/0819* (2013.01); *G03G 9/0827* (2013.01); *G03G 9/08755* (2013.01); *G03G 9/08795* (2013.01); *G03G 9/08797* (2013.01); *G03G 9/09392* (2013.01)

(58) Field of Classification Search

USPC ..... 430/137.14, 109.4

See application file for complete search history.

(56) References Cited

U.S. PATENT DOCUMENTS

| | | | |
|---|---|---|---|
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |

(Continued)

FOREIGN PATENT DOCUMENTS

| | | | |
|---|---|---|---|
| GB | 1442835 | A | 7/1976 |

*Primary Examiner* — Peter Vajda

(74) *Attorney, Agent, or Firm* — Pillsbury Winthrop Shaw Pittman LLP

(57) ABSTRACT

A method for preparing toner particles is disclosed. In embodiments, a suitable method includes aggregating a mixture comprising at least one resin, an optional pigment and an optional wax to form aggregated particles, freezing aggregation of particles by adjusting the pH of the aggregated particles to a freezing aggregation pH; coalescing the aggregated particles to form toner particles at a first pH that is higher than the freezing aggregation pH; and recovering the toner particles.

11 Claims, 3 Drawing Sheets

(56) References Cited

U.S. PATENT DOCUMENTS

| | | | | |
|---|---|---|---|---|
| 5,763,133 | A | 6/1998 | Ong et al. | |
| 5,766,818 | A | 6/1998 | Smith et al. | |
| 5,804,349 | A | 9/1998 | Ong et al. | |
| 5,827,633 | A | 10/1998 | Ong et al. | |
| 5,840,462 | A | 11/1998 | Foucher et al. | |
| 5,853,944 | A | 12/1998 | Foucher et al. | |
| 5,863,698 | A | 1/1999 | Patel et al. | |
| 5,869,215 | A | 2/1999 | Ong et al. | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,925,488 | A | 7/1999 | Patel et al. | |
| 5,977,210 | A | 11/1999 | Patel et al. | |
| 6,063,827 | A | 5/2000 | Sacripante et al. | |
| 6,120,967 | A | 9/2000 | Hopper et al. | |
| 6,593,049 | B1 | 7/2003 | Veregin et al. | |
| 6,730,450 | B1 | 5/2004 | Moffat et al. | |
| 6,743,559 | B2 | 6/2004 | Combes et al. | |
| 6,756,176 | B2 | 6/2004 | Stegamat et al. | |
| 6,780,500 | B2 | 8/2004 | Dumouchel | |
| 6,830,860 | B2 | 12/2004 | Sacripante et al. | |
| 7,029,817 | B2 | 4/2006 | Robinson et al. | |
| 7,329,476 | B2 | 2/2008 | Sacripante et al. | |
| 8,142,975 | B2 | 3/2012 | Vanbesien et al. | |
| 8,460,848 | B2 | 6/2013 | Qiu et al. | |
| 2008/0166649 | A1* | 7/2008 | Moffat et al. | 430/108.8 |
| 2011/0097664 | A1* | 4/2011 | Nosella et al. | 430/137.14 |
| 2012/0107740 | A1* | 5/2012 | Jugle et al. | 430/137.11 |
| 2012/0276478 | A1* | 11/2012 | Wosnick et al. | 430/109.4 |

* cited by examiner

TONER PROCESSES

BACKGROUND

The presently disclosed embodiments relate generally to improved coalescence processes for producing toner. Particularly, embodiments disclosed herein relate to improved coalescence processes for preparing emulsion aggregation (EA) toner particles.

Emulsion aggregation/coalescing processes for the preparation of toners are illustrated in a number of Xerox patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488 and 5,977,210. Other patents disclosing exemplary emulsion aggregation/coalescing processes include, for example, U.S. Pat. Nos. 6,730,450, 6,743,559, 6,756,176, 6,780,500, 6,830,860, and 7,029,817. The disclosures of each of the foregoing patents and publications are hereby incorporated by reference herein in their entireties. The appropriate components and process aspects of the each of the foregoing patents and publications may also be selected for the present compositions and processes in embodiments thereof.

In an aggregation/coalescing process for preparing toners, the coalescence process is an important step to determine the fusing and charging performance to toners Therefore, there is a need to develop an optimal coalescence condition and process to impart excellent fusing and charging characteristics for toners.

SUMMARY

This present disclosure provides a method for preparing a toner, comprising aggregating a mixture comprising at least one resin, an optional pigment and an optional wax to form aggregated particles; freezing aggregation of particles by adjusting the pH of the aggregated particles to a freezing aggregation pH of from about 5 to about 9; coalescing the aggregated particles to form toner particles at a first pH that is higher than the freezing aggregation pH; and recovering the toner particles.

Certain embodiment provides a method for preparing a toner, comprising aggregating a mixture comprising a bio-based resin and an optional wax to form aggregated particles; freezing aggregation of particles by adjusting the pH of the aggregated particles to a freezing aggregation pH of from about 5 to about 9; coalescing the aggregated particles to form toner particles at a first pH of from about 8 to about 13 and subsequently reducing the pH to a second pH of from about 4 to about 10; and recovering the toner particles; wherein the average circularity of the toner particles is from about 0.940 to about 0.990.

Certain other embodiments provides a method for preparing a toner, comprising aggregating a mixture comprising a bio-based resin and an optional wax to form aggregated particles; freezing aggregation of particles by adjusting the pH of the aggregated particles to a freezing aggregation pH of from about 5 to about 9; coalescing the aggregated particles to form toner particles at a second pH of from about 4 to about 10 and subsequently increasing the pH to a first pH of from about 8 to about 13, wherein the first pH is from about 0.2 pH unit to about 2 units higher than the freezing aggregation pH; and recovering the toner particles; wherein the average circularity of the toner particles is from about 0.940 to about 0.990.

BRIEF DESCRIPTION OF THE DRAWINGS

For a better understanding of the present embodiments, reference may be made to the accompanying figures.

DETAILED DESCRIPTION

Figure 1A:
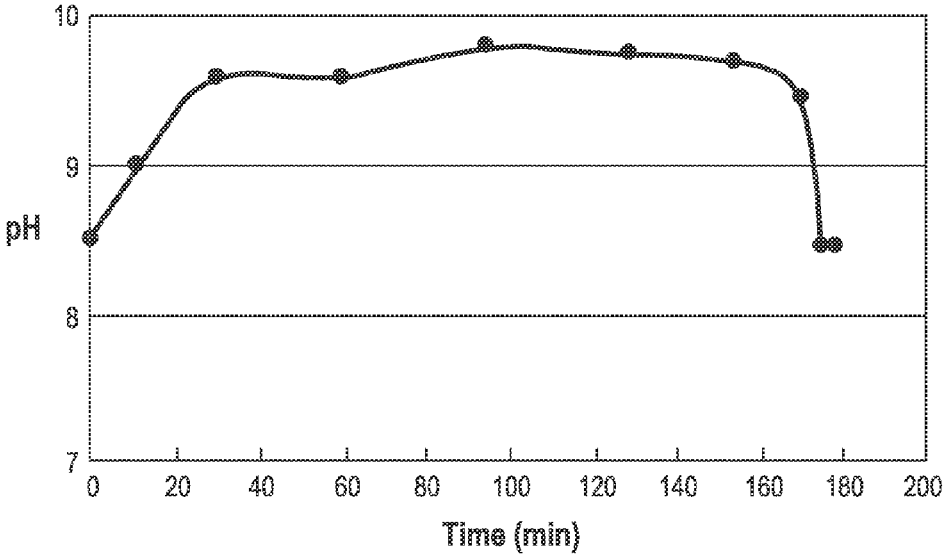
FIG. 1A is a graph illustrating the change of pH during a coalescence process in accordance with an embodiment of the disclosure.

In the following description, reference is made to the accompanying drawings, which form a part hereof and which illustrate several embodiments.

Toners prepared in accordance with the present disclosure provide desired fusing characteristics including, for example, desired release characteristics such as stripping force, for example of less than about 30 grams of force to less than about 5 grams of force, desired blocking characteristics such as for example, a high blocking temperature of about 45° C. to about 65° C., desired document offset characteristics, such as a document offset of about 2.0 to about 5.0 desired vinyl offset characteristics, such as a vinyl offset of about 3.0 to about 5.0 and desired triboelectrical charging characteristics. Further, toners prepared in accordance with the present disclosure enable in embodiments, the use of lower minimum imaging fusing temperatures, such as from about 100° C. to about 170° C., enable high speed printing such as for machines running at greater than about 35 pages per minute.

The toner particles prepared from the method of the present disclosure may have an average circularity of from about 0.940 to about 0.990, from 0.945 to 0.975, or from 0.950 to about 0.970. The toner particles may have an average size of from about 3 microns to about 10 microns, from about 3.5 microns to about 8.5 microns, or from about 3.8 microns to about 7 microns. The toner particles may have a relatively narrow particle size distribution with a lower number ratio geometric standard deviation (GSDn) of about 1.10 to about 1.40, such as from about 1.15 to about 1.35, or from about 1.20 to about 1.30. The toner particles may also exhibit an upper geometric standard deviation by volume (GSDv) in the range of from about 1.15 to about 1.35, such as from about 1.16 to about 1.30, or from about 1.17 to about 1.25.

The present disclosure provides a method for preparing a toner. In particular, the method includes a coalescing step (i.e., coalescence) conducted at a pH that is higher than the freezing aggregation pH. The term "freezing aggregation pH" used herein refers to the pH at which the size of the aggregated toner particles is frozen. The freezing aggregation pH provides a pH environment to stop the growth of the toner. The freezing aggregation pH is typically in the range between about 5 and about 9, for example, from about 6 to about 8.5, or from about 7 to about 8.3.

The coalescence of the disclosure can be conducted at a first pH of from about 8 to about 13, from about 8 to about 11, from about 8 to about 10. The first pH can be from about 0.2 pH unit to about 5 pH units, from about 0.2 pH unit to about 2 pH units, from about 0.5 pH unit to about 2 pH units, or from about 0.5 pH unit to about 1.5 pH units higher than the freezing aggregation pH. The pH level of the aggregated particles can be maintained within the range of the first pH (i.e., varies within the disclosed pH range or keeps at a constant pH level) for from about 1 minutes to about 10 hours, from about 5 minutes to about 6 hours, or from about 10 minutes to about 5 hours.

The coalescence of the disclosure can further be conducted at a second pH of from about 4 to about 10, from about 5 to about 9, from about 6 to about 9, from about 6.5 to about 8. The second pH can be from about 0.1 pH unit to about 5 pH units, or from about 0.2 pH unit to about 4 pH units lower than the first pH. The second pH can be higher or lower than the freezing aggregation pH. During coalescence, the pH level of the aggregated particles can be maintained within the range of the second pH for about 1 minutes to about 10 hours, for about 5 minutes to about 6 hours, or for about 10 minutes to about 5 hours.

Coalescence may be accomplished over a period of from about 1 minutes to about 10 hours, from about 5 minutes to about 6 hours, or from about 10 minutes to about 5 hours (although times outside of these ranges can be used).

In embodiments, the coalescence can be conducted by adjusting the pH of the aggregated particles from the freezing aggregation pH to the first pH and subsequently decreasing the pH from the first pH to the second pH.

In other embodiments, the coalescence is conducted by adjusting the pH of the aggregated particles from the freezing aggregation pH to the second pH and subsequently increasing the pH from the second pH to the first pH.

The coalescence can be achieved by, for example, heating the mixture to a temperature of from about 60° C. to about 99° C., such as from about 65° C. to about 95° C., or from about 70° C. to about 90° C. (although temperatures outside of these ranges may be used), which can be at or above the glass transition temperature of the resins used to form the toner particles, and/or reducing the stirring, for example, to a stirring speed of from about 50 revolutions per minute to about 1,000 revolutions per minute, such as from about 100 revolutions per minute to about 800 revolutions per minute (although speeds outside of these ranges may be used). The fused particles can be measured for shape factor or circularity, such as with a Sysmex FPIA 2100 analyzer, until the desired shape is achieved.

Coalescence may be accomplished over a period of from about 1 minutes to about 10 hours, from about 5 minutes to about 6 hours, or from about 10 minutes to about 5 hours (although times outside of these ranges can be used).

Resin

The resin may comprise one or more resins, such as two or more resins. The total amount of resin in the resin composition can be from about 1% to 99%, such as from about 10% to about 95%, or from about 20% to about 90% by weight of the resin composition.

A resin used in the method disclosed herein may be any latex resin utilized in forming Emulsion Aggregation (EA) toners. Such resins, in turn, may be made of any suitable monomer. Any monomer employed may be selected depending upon the particular polymer to be used. Two main types of EA methods for making toners are known. First is an EA process that forms acrylate based, e.g., styrene acrylate, toner particles. See, for example, U.S. Pat. No. 6,120,967, incorporated herein by reference in its entirety, as one example of such a process. Second is an EA process that forms polyester, e.g., sodio sulfonated polyester. See, for example, U.S. Pat. No. 5,916,725, incorporated herein by reference in its entirety, as one example of such a process.

Illustrative examples of latex resins or polymers selected for the non crosslinked resin and crosslinked resin or gel include, but are not limited to, styrene acrylates, styrene methacrylates, butadienes, isoprene, acrylonitrile, acrylic acid, methacrylic acid, beta-carboxy ethyl arylate, polyesters, known polymers such as poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and the like, and mixtures thereof. The resin or polymer can be a styrene/butyl acrylate/carboxylic acid terpolymer. At least one of the resin substantially free of crosslinking and the cross linked resin can comprise carboxylic acid in an amount of from about 0.05 to about 10 weight percent based upon the total weight of the resin substantially free of cross linking or cross linked resin.

The monomers used in making the selected polymer are not limited, and the monomers utilized may include any one or more of, for example, styrene, acrylates such as methacrylates, butylacrylates, β-carboxy ethyl acrylate (β-CEA), etc., butadiene, isoprene, acrylic acid, methacrylic acid, itaconic acid, acrylonitrile, benzenes such as divinylbenzene, etc., and the like. Known chain transfer agents, for example dodecanethiol or carbon tetrabromide, can be utilized to control the molecular weight properties of the polymer. Any suitable method for forming the latex polymer from the monomers may be used without restriction.

The resin that is substantially free of cross linking (also referred to herein as a non cross linked resin) can comprise a resin having less than about 0.1 percent cross linking. For example, the non cross linked latex can comprise styrene, butylacrylate, and beta-carboxy ethyl acrylate (beta-CEA) monomers, although not limited to these monomers, termed herein as monomers A, B, and C, prepared, for example, by emulsion polymerization in the presence of an initiator, a chain transfer agent (CTA), and surfactant.

The resin substantially free of cross linking can comprise styrene:butylacrylate:beta-carboxy ethyl acrylate wherein, for example, the non cross linked resin monomers can be present in an amount of about 70 percent to about 90 percent styrene, about 10 percent to about 30 percent butylacrylate, and about 0.05 parts per hundred to about 10 parts per hundred beta-CEA, or about 3 parts per hundred beta-CEA, by weight based upon the total weight of the monomers, although not limited. For example, the carboxylic acid can be selected, for example, from the group comprised of, but not limited to, acrylic acid, methacrylic acid, itaconic acid, beta carboxy ethyl acrylate (beta CEA), fumaric acid, maleic acid, and cinnamic acid.

In a feature herein, the non cross linked resin can comprise about 73 percent to about 85 percent styrene, about 27 percent to about 15 percent butylacrylate, and about 1.0 part per hundred to about 5 parts per hundred beta-CEA, by weight based upon the total weight of the monomers although the compositions and processes are not limited to these particular types of monomers or ranges. In another feature, the non cross linked resin can comprise about 81.7 percent styrene, about 18.3 percent butylacrylate and about 3.0 parts per hundred beta-CEA by weight based upon the total weight of the monomers.

The initiator can be, for example, but is not limited to, sodium, potassium or ammonium persulfate and can be present in the range of, for example, about 0.5 to about 3.0 percent based upon the weight of the monomers, although not limited. The CTA can be present in an amount of from about 0.5 to about 5.0 percent by weight based upon the combined weight of the monomers A and B, although not limited. The surfactant can be an anionic surfactant present in the range of from about 0.7 to about 5.0 percent by weight based upon the weight of the aqueous phase, although not limited to this type or range.

The resin can be a polyester resin such as an amorphous polyester resin, a crystalline polyester resin, and/or a combination thereof. The polymer used to form the resin can be a polyester resin described in U.S. Pat. Nos. 6,593,049 and 6,756,176, the disclosures of each of which are hereby incorporated by reference in their entirety. Suitable resins also include a mixture of an amorphous polyester resin and a crystalline polyester resin as described in U.S. Pat. No. 6,830,860, the disclosure of which is hereby incorporated by reference in its entirety.

The resin can be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, such as from about 42 to about 55 mole percent, or from about 45 to about 53 mole percent (although amounts outside of these ranges can be used), and the alkali sulfo-aliphatic diol can be selected in an amount of from about 0 to about 10 mole percent, such as from about 1 to about 4 mole percent of the resin (although amounts outside of these ranges can be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, from about 40 to about 60 mole percent, in embodiments from about 42 to about 52 mole percent, such as from about 45 to about 50 mole percent (although amounts outside of these ranges can be used), and the alkali sulfo-aliphatic diacid can be selected in an amount of from about 1 to about 10 mole percent of the resin (although amounts outside of these ranges can be used).

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin can be present, for example, in an amount of from about 1 to about 50 percent by weight of the toner components, such as from about 2 to about 35 percent by weight of the toner components (although amounts outside of these ranges can be used). The crystalline resin can possess various melting points of, for example, from about 30° C. to about 120° C., in embodiments from about 50° C. to about 90° C. (although melting points outside of these ranges can be obtained). The crystalline resin can have a number average molecular weight (Mn), as measured by gel permeation chromatography (GPC) of, for example, from about 1,000 to about 50,000, such as from about 2,000 to about 25,000 (although number average molecular weights outside of these ranges can be obtained), and a weight average molecular weight (Mw) of, for example, from about 2,000 to about 100,000, such as from about 3,000 to about 80,000 (although weight average molecular weights outside of these ranges can be obtained), as determined by Gel Permeation Chromatography using polystyrene standards. The molecular weight distribution (Mw/Mn) of the crystalline resin can be, for example, from about 2 to about 6, in embodiments from about 3 to about 4 (although molecular weight distributions outside of these ranges can be obtained).

Examples of diacids or diesters including vinyl diacids or vinyl diesters used for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester can be present, for example, in an amount from about 40 to about 60 mole percent of the resin, such as from about 42 to about 52 mole percent of the resin, or from about 45 to about 50 mole percent of the resin (although amounts outside of these ranges can be used).

Examples of diols that can be used in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and can be present, for example, in an amount from about 40 to about 60 mole percent of the resin, such as from about 42 to about 55 mole percent of the resin, or from about 45 to about 53 mole percent of the resin (although amounts outside of these ranges can be used).

Polycondensation catalysts which may be used in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be used in amounts of, for example, from about 0.01 mole percent to about 5 mole percent based on the starting diacid or diester used to generate the polyester resin (although amounts outside of this range can be used).

Suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be used include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfoisophthalate), copoly propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

An unsaturated amorphous polyester resin can be used as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof. A suitable polyester resin can be a polyalkoxylated bisphenol A-co-terephthalic acid/dodecenylsuccinic acid/trimellitic acid resin, or a polyalkoxylated bisphenol A-co-terephthalic acid/fumaric acid/dodecenylsuccinic acid resin, or a combination thereof.

Such amorphous resins can have a weight average molecular weight (Mw) of from about 10,000 to about 100,000, such as from about 15,000 to about 80,000.

An example of a linear propoxylated bisphenol a fumarate resin that can be used as a latex resin is available under the trade name SPARII from Resana S/A Industrias Quimicas, Sao Paulo Brazil. Other propoxylated bisphenol a fumarate resins that can be used and are commercially available include GTUF and FPESL-2 from Kao Corporation, Japan, and EM181635 from Reichhold, Research Triangle Park, North Carolina, and the like.

Suitable crystalline resins that can be used, optionally in combination with an amorphous resin as described above, include those disclosed in U.S. Patent Application Publication No. 2006/0222991, the disclosure of which is hereby incorporated by reference in its entirety. In embodiments, a suitable crystalline resin can include a resin formed of dodecanedioic acid and 1,9-nonanediol.

Such crystalline resins can have a weight average molecular weight (Mw) of from about 10,000 to about 100,000, such as from about 14,000 to about 30,000.

For example, a polyalkoxylated bisphenol A-co-terephthalic acid/dodecenylsuccinic acid/trimellitic acid resin, or a polyalkoxylated bisphenol A-co-terephthalic acid/fumaric acid/dodecenylsuccinic acid resin, or a combination thereof, can be combined with a polydodecanedioic acid-co-1,9-nonanediol crystalline polyester resin.

The resins can have a glass transition temperature of from about 30° C. to about 80° C., such as from about 45° C. to about 75° C. The resins can have a melt viscosity of from about 10 to about 1,000,000 Pa*S at about 130° C., such as from about 20 to about 100,000 Pa*S. One, two, or more toner resins may be used. Where two or more toner resins are used, the toner resins can be in any suitable ratio (e.g., weight ratio) such as, for instance, about 10 percent (first resin)/90 percent (second resin) to about 90 percent (first resin)/10 percent (second resin). The resin can be formed by emulsion polymerization methods.

The resin can be formed at elevated temperatures of from about 30° C. to about 250° C., such as from about 50° C. to about 240° C., or from about 70° C. to about 230° C. However, the resin can also be formed at room temperature.

Stirring may be used to enhance formation of the resin. Any suitable stirring device may be used. In embodiments, the stirring speed can be from about 10 revolutions per minute (rpm) to about 5,000 rpm, such as from about 20 rpm to about 2,000 rpm, or from about 50 rpm to about 1,000 rpm. The stirring speed can be constant or the stirring speed can be varied. For example, as the temperature becomes more uniform throughout the mixture, the stirring speed can be increased. However, no mechanical or magnetic agitation is necessary in the method disclosed herein.

In embodiments, resins utilized in accordance with the present disclosure may also include a bio-based resin. As used herein, "bio-based," or use of the prefix, "bio," refers to a reagent or to a product that is composed, in whole or in part, of a biological product, including plant, animal and marine materials, or derivatives thereof. Generally, a bio-based or biomaterial is biodegradable, that is, substantially or completely biodegradable, by substantially is meant greater than 50%, greater than 60%, greater than 70% or more of the material is degraded from the original molecule to another form by a biological or environmental mechanism, such as, action thereon by bacteria, animals, plants, light, temperature, oxygen and so on in a matter of days, matter of weeks, a year or more, but generally no longer than two years. A, "bio-resin," is a resin, such as, a polyester, which contains or is composed of a bio-based material in whole or in part.

As used herein, a "rosin," or, "rosin product," is intended to encompass a rosin, a rosin acid, a rosin ester and so on, as well as a rosin derivative which is a rosin that is treated, for example, disproportionated or hydrogenated. As known in the art, rosin is a blend of at least eight monocarboxylic acids. Abietic acid can be a primary species, and the other seven acids are isomers thereof. Because of the composition of a rosin, often the synonym, "rosin acid," is used to describe various rosin-derived products. As known, rosin is not a polymer but essentially a varying blend of the eight species of carboxylic acids. A rosin product includes, as known in the art, chemically modified rosin, such as, partially or fully hydrogenated rosin acids, partially or fully dimerized rosin acids, esterified rosin acids, functionalized rosin acids, disproportionated or combinations thereof. Rosin is available commercially in a number of forms, for example, as a rosin acid, as a rosin ester and so on. For example, rosin acids, rosin ester and dimerized rosin are available from Eastman Chemicals under the product lines, Poly-Pale™, Dymerex™, Staybelite-E™, Foral™ Ax-E, Lewisol™ and Pentalyn™; Arizona Chemicals under the product lines, Sylvalite™ and Sylvatac™; and Arakawa-USA under the product lines, Pensel and Hypal. Disproportionated rosins are available commercially, for example, KR-614 and Rondis™ available from Arakawa-USA, and hydrogenated rosin is available commercially, for example, Foral AX™ available from Pinova Chemicals.

A rosin acid can be reacted with an organic bis-epoxide, which during a ring-opening reaction of the epoxy group, combines at the carboxylic acid group of a rosin acid to form a joined molecule, a bis-rosin ester. Such a reaction is known in the art and is compatible with the one-pot reaction conditions disclosed herein for producing a bio-resin. A catalyst can be included in the reaction mixture to form the rosin ester. Suitable catalysts include tetra-alkyl ammonium halides, such as, tetraethyl ammonium bromide, tetraethyl ammonium iodide, tetraethyl ammonium chloride, tetra-alkyl phosphonium halides and so on. The reaction can be conducted under anaerobic conditions, for example, under a nitrogen atmosphere. The reaction can be conducted at an elevated temperature, such as, from about 100° C. to about 200° C., from about 105° C. to about 175° C., from about 110° C. to about 170° C. and so on, although temperatures outside of those ranges can be used as a design choice. The progress of this reaction can be monitored by evaluating the acid value of the reaction product, and when all or most of the rosin acid has reacted the overall acid value of the product is less than about 4 meq of KOH/g, less than about 1 meq of KOH/g, about 0 meq of KOH/g. The acid value of a resin can be manipulated by adding an excess of bis-epoxide monomer. The aforementioned rosin-diol is then reacted with terephthalic acid (or dimethyl terephthalate), and succinic acid and an excess of excess 1,2-propand-diol to form the bio-based polyester resin by polycondensation process with removal of the water (and/or methanol) byproduct and some of the excess 1,2-propanediol. Furthermore, at the end of the polycondensation step, suitable acids include biopolycarboxylic acids, such as, organic acids, such as, fumaric acid, succinic acid, oxalic acid, malonic acid, glutaric acid, adipic acid, suberic acid, azelaic acid, maleic acid can be added to control the acid value of the bio-based resin such that an acid value of from about 8 to about 16 meq of KOH/g is obtained.

In embodiments, a suitable amorphous bio-based resin may have a glass transition temperature of from about 30° C. to about 80° C., in embodiments from about 45° C. to about 75° C., a weight average molecular weight (Mw) of from about 2,000 to about 200,000, in embodiments of from about 5,000 to about 100,000, a number average molecular weight (Mn) as measured by gel permeation chromatography (GPC) of from about 1,000 to about 10,000, in embodiments from about 2,000 to about 8,000, a molecular weight distribution (Mw/Mn) of from about 2 to about 20, in embodiments from about 3 to about 15, and a viscosity at about 130° C. of from about 10 Pa*S to about 100000 Pa*S, in embodiments from about 50 Pa*S to about 10000 Pa*S.

The bio-based resin may be present, for example, in amounts of from about 10 to about 95 percent by weight of the toner components, in embodiments from about 20 to about 80 percent by weight, or from about 25 to about 60 percent of the toner, although the amount of the amorphous bio-based resin can be outside of these ranges.

In embodiments, suitable latex resin particles may include one or more of the crystalline resins described above, and one or more bio-based resins. In embodiments, the weight ratio of bio-based resin to crystalline resin is from about 99%:1% to about 50%:50%, from about 98%:2% to about 60%:40%, or from about 95%:5% to about 75%:25%.

Solvent

Any suitable organic solvent can be contacted with the resin in the resin composition to help dissolve the resin in the resin composition. Suitable organic solvents for the methods disclosed herein include alcohols, such as methanol, ethanol, isopropanol, butanol, as well as higher homologs and polyols, such as ethylene glycol, glycerol, sorbitol, and the like; ketones, such as acetone, 2-butanone, 2-pentanone, 3-pentanone, ethyl isopropyl ketone, methyl isobutyl ketone, diisobutyl ketone, and the like; amides, such as dimethylformamide, dimethylacetamide, N-methylpyrrolidone, 1,2-dimethyl-2-imidazolidinone, and the like; nitriles, such as acetonitrile, propionitrile, butyronitrile, isobutyronitrile, valeronitrile, benzonitrile, and the like; ethers, such as ditertbutyl ether, dimethoxyethane, 2-methoxyethyl ether, 1,4-dioxane, tetrahydrohyran, morpholine, and the like; sulfones, such as methylsulfonylmethane, sulfolane, and the like; sulfoxides, such as dimethylsulfoxide; phosphoramides, such as hexamethylphosphoramide; benzene and benzene derivatives; as well as esters, amines and combinations thereof, in an amount of, for example from about 1 wt % to 99 wt %, from about 20 wt % to 80 wt %, or from about 20 wt % to about 50 wt %.

The organic solvent can be immiscible in water and can have a boiling point of from about 30° C. to about 100° C. Any suitable organic solvent can also be used as a phase or solvent inversion agent. The organic solvent can be used in an amount of from about 1% by weight to about 25% by weight of the resin, such as from about 5% by weight to about 20% by weight of the resin, or from about 10% by weight of the resin to about 15% by weight of the resin.

Neutralizing Agent

A neutralizing agent can be contacted with the resin in the resin composition to, for example, neutralize acid groups in the resins. The neutralizing agent can be contacted with the resin as a solid or in an aqueous solution. The neutralizing agent herein can also be referred to as a "basic neutralization agent." Any suitable basic neutralization reagent can be used in accordance with the present disclosure.

Suitable basic neutralization agents include both inorganic basic agents and organic basic agents. Suitable basic agents include, for example, ammonium hydroxide, potassium hydroxide, sodium hydroxide, sodium carbonate, sodium bicarbonate, lithium hydroxide, potassium carbonate, potassium bicarbonate, combinations thereof, and the like. Suitable basic agents also include monocyclic compounds and polycyclic compounds having at least one nitrogen atom, such as, for example, secondary amines, which include aziridines, azetidines, piperazines, piperidines, pyridines, pyridine derivatives, bipyridines, terpyridines, dihydropyridines, morpholines, N-alkylmorpholines, 1,4-diazabicyclo[2.2.2] octanes, 1,8-diazabicycloundecanes, 1,8-diazabicycloundecenes, dimethylated pentylamines, trimethylated pentylamines, triethyl amines, triethaholamines, diphenyl amines, diphenyl amine derivatives, poly(ethylene amine), poly(ethylene amine derivatives, amine bases, pyrimidines, pyrroles, pyrrolidines, pyrrolidinones, indoles, indolines, indanones, benzindazones, imidazoles, benzimidazoles, imidazolones, imidazolines, oxazoles, isoxazoles, oxazolines, oxadiazoles, thiadiazoles, carbazoles, quinolines, isoquinolines, naphthyridines, triazines, triazoles, tetrazoles, pyrazoles, pyrazolines, and combinations thereof. The monocyclic and polycyclic compounds can be unsubstituted or substituted at any carbon position on the ring.

The basic agent can be used as a solid such as, for example, sodium hydroxide flakes, so that it is present in an amount of from about 0.001% by weight to 50% by weight of the resin, such as from about 0.01% by weight to about 25% by weight of the resin, or from about 0.1% by weight to 5% by weight of the resin.

As noted above, the basic neutralization agent can be added to a resin possessing acid group. The addition of the basic neutralization agent may thus raise the pH of an emulsion including a resin possessing acid group to a pH of from about 5 to about 12, in embodiments, from about 6 to about 11. The neutralization of the acid groups can enhance formation of the emulsion.

The neutralization ratio can be from about 25% to about 500%, such as from about 40% to about 450%, or from about 60% to about 400%.

Waxes

The resin emulsion may be prepared to include a wax. In these embodiments, the emulsion will include resin and wax particles at the desired loading levels, which allows for a single resin and wax emulsion to be made rather than separate resin and wax emulsions. Further, the combined emulsion allows for reduction in the amount of surfactant needed to prepare separate emulsions for incorporation into toner compositions. This is particularly helpful in instances where it would otherwise be difficult to incorporate the wax into the emulsion. However, the wax can also be separately emulsified, such as with a resin, and separately incorporated into final products.

The toners may also contain a wax, either a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes may be added to provide multiple properties to the toner composition.

Examples of suitable waxes include waxes selected from natural vegetable waxes, natural animal waxes, mineral waxes, synthetic waxes, and functionalized waxes. Natural vegetable waxes include, for example, carnauba wax, candelilla wax, rice wax, sumacs wax, jojoba oil, Japan wax, and bayberry wax. Examples of natural animal waxes include, for example, beeswax, panic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, diglyceryl distearate, dipropyleneglycol distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

In some embodiments, the wax may be selected from polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K. K., and similar materials. The commercially available polyethylenes usually possess a molecular weight (Mw) of from about 500 to about 2,000, such as from about 1,000 to about 1,500, while the commercially available polypropylenes used have a molecular weight of from about 1,000 to about 10,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., and chlorinated polyethylenes and polypropylenes commercially available from Allied Chemical and Petrolite Corporation and Johnson Diversey, Inc. The polyethylene and polypropylene compositions may be selected from those illustrated in British Pat. No. 1,442,835, the entire disclosure of which is incorporated herein by reference.

The toners may contain the wax in any amount of from, for example, about 1 to about 25 wt % of the toner, such as from about 3 to about 15 wt % of the toner, on a dry basis; or from about 5 to about 20 wt % of the toner, or from about 5 to about 11 wt % of the toner.

Surfactant

As discussed above, a surfactant can be contacted with the resin prior to formation of the resin composition used to form the latex emulsion. One, two, or more surfactants can be used. The surfactants can be selected from ionic surfactants and nonionic surfactants. The latex for forming the resin used in forming a toner can be prepared in an aqueous phase containing a surfactant or co-surfactant, optionally under an inert gas such as nitrogen. Surfactants used with the resin to form a latex dispersion can be ionic or nonionic surfactants in an amount of from about 0.01 to about 15 weight percent of the solids, such as from about 0.1 to about 10 weight percent of the solids.

Anionic surfactants that can be used include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN®, NEOGEN SC™ obtained from Daiichi Kogyo Seiyaku Co., Ltd., combinations thereof, and the like. Other suitable anionic surfactants include, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants can be used.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. A suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. Commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be used.

The choice of particular surfactants or combinations thereof, as well as the amounts of each to be used, are within the purview of those skilled in the art.

Colorants

The toners may also contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, and mixtures thereof, in an amount of about 0.1 to about 35 wt % based upon the total weight of the composition, such as from about 1 to about 25 wt %.

In general, suitable colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-1,1-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF), and carbon blacks such as REGAL 330 (Cabot), Carbon Black 5250 and 5750 (Columbian Chemicals), and the like, and mixtures thereof.

Additional colorants include pigments in water-based dispersions such as those commercially available from Sun Chemical, for example SUNSPERSE BHD 6011 X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 12273915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226), and the like, and mixtures thereof. Other water based colorant dispersions include those commercially available from Clariant, for example, HOSTAFINE Yellow GR, HOSTAFINE Black T and Black TS, HOSTAFINE Blue B2G, HOSTAFINE Rubine F6B, and magenta dry pigment such as Toner Magenta 6BVP2213 and Toner Magenta EO2 that may be dispersed in water and/or surfactant prior to use.

Other colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like, and mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E. D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like, and mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, and mixtures thereof. Illustrative examples of yellows that may be selected include diarylide yellow 3,3-dichlorobenzidene acetoacetanilides, a monoazo pigment identified in the Color Index as CI-12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components, may also be selected as pigments.

The colorant, such as carbon black, cyan, magenta, and/or yellow colorant, is incorporated in an amount sufficient to impart the desired color to the toner. In general, pigment or dye is employed in an amount ranging from about 1 to about 35 wt % of the toner particles on a solids basis, such as from about 5 to about 25 wt %, or from about 5 to about 15 wt %. However, amounts outside these ranges can also be used.

Preparation of Toner

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, the toner preparation process includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization may be accomplished by mixing at about 3,000 to about 5,000 revolutions per minute. Homogenization may be accomplished by any suitable means, including, for example, an IKA ULTRA TURRAX T50 probe homogenizer.

Aggregation

Following the preparation of the above mixture, an aggregating agent may be added to the mixture. Any suitable aggregating agent can be used to form a toner. Suitable aggregating agents include, for example, aqueous solutions of a divalent cation or a multivalent cation material. The aggregating agent can be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. The aggregating agent can be added to the mixture at a temperature that is below the glass transition temperature (Tg) of the resin.

The aggregating agent can be added to the mixture used to form a toner in an amount of, for example, from about 0.01 percent to about 8 percent by weight, such as from about 0.1 percent to about 1 percent by weight, or from about 0.15 percent to about 0.8 percent by weight, of the resin in the mixture, although amounts outside these ranges can be used. The above can provide a sufficient amount of agent for aggregation.

The particles can be permitted to aggregate until a predetermined desired particle size is obtained. A predetermined desired size refers to the desired particle size to be obtained as determined prior to formation, and the particle size being monitored during the growth process until such particle size is reached. Samples can be taken during the growth process and analyzed, for example with a Coulter Counter, for average particle size. The aggregation thus can proceed by maintaining the elevated temperature, or slowly raising the temperature to, for example, from about 30° C. to about 99° C., and holding the mixture at this temperature for a time from about 0.5 hours to about 10 hours, such as from about hour 1 to about 5 hours (although times outside these ranges may be utilized), while maintaining stirring, to provide the aggregated particles. Once the predetermined desired particle size is reached, then the growth process is halted. The predetermined desired particle size can be within the desired size of the final toner particles.

The growth and shaping of the particles following addition of the aggregation agent can be accomplished under any suitable conditions. For example, the growth and shaping can be conducted under conditions in which aggregation occurs separate from coalescence. For separate aggregation and coalescence stages, the aggregation process can be conducted under shearing conditions at an elevated temperature, for example, of from about 40° C. to about 90° C., such as from about 45° C. to about 80° C. (although temperatures outside these ranges may be utilized), which can be below the glass transition temperature of the resin as discussed above.

Once the desired final size of the aggregated particles is achieved, aggregation is frozen by adjusting the pH of the resulting mixture to a freezing aggregation pH of from about 5 to about 9. The base may be utilized to freeze (i.e., to stop) toner growth, that can include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Core-Shell Structure

After aggregation, but prior to coalescence, a resin coating can be applied to the aggregated particles to form a shell thereover. Any resin described above as suitable for forming the toner resin can be used as the shell.

Resins that can be used to form a shell include, but are not limited to, crystalline polyesters described above, and/or the amorphous resins described above for use as the core. For example, a polyalkoxylated bisphenol A-co-terephthalic acid/dodecenylsuccinic acid/trimellitic acid resin, a polyalkoxylated bisphenol A-co-terephthalic acid/fumaric acid/dodecenylsuccinic acid resin, or a combination thereof, can be combined with a polydodecanedioic acid-co-1,9-nonanediol crystalline polyester resin to form a shell. Multiple resins can be used in any suitable amounts.

The shell resin can be applied to the aggregated particles by any method within the purview of those skilled in the art. The resins utilized to form the shell can be in an emulsion including any surfactant described above. The emulsion possessing the resins can be combined with the aggregated particles described above so that the shell forms over the aggregated particles. In embodiments, the shell may have a thickness of up to about 5 microns, such as from about 0.1 to about 2 microns, or from about 0.3 to about 0.8 microns, over the formed aggregates, although thicknesses outside of these ranges may be obtained.

The formation of the shell over the aggregated particles can occur while heating to a temperature of from about 30° C. to about 80° C. in embodiments from about 35° C. to about 70° C., although temperatures outside of these ranges can be utilized. The formation of the shell can take place for a period of time of from about 5 minutes to about 10 hours, such as from about 10 minutes to about 5 hours, although times outside these ranges may be used.

For example, the toner process can include forming a toner particle by mixing the polymer latexes, in the presence of a wax dispersion and a colorant with an optional coagulant while blending at high speeds. The resulting mixture having a pH of, for example, of from about 2 to about 3, can be aggregated by heating to a temperature below the polymer resin Tg to provide toner size aggregates. Optionally, additional latex can be added to the formed aggregates providing a shell over the formed aggregates. The pH of the mixture can be changed, for example, by the addition of a sodium hydroxide solution, until a pH of about 7 may be achieved.

Coalescence

Following aggregation to the desired particle size and application of any optional shell, the particles can be coalesced to the desired final shape following the coalescence conditions described in the present disclosure at a temperature from 60° C. to 99° C.

After aggregation and coalescence, the mixture can be cooled to room temperature, such as from about 20° C. to about 25° C. The cooling can be rapid or slow, as desired. Suitable cooling methods include introducing cold water to a jacket around the reactor. After cooling, the toner particles can be washed with water, and then dried. Drying can be accomplished by any suitable method for drying including, for example, freeze-drying.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

The embodiments will be described in further detail with reference to the following examples and comparative examples. All the "parts" and "%" used herein mean parts by weight and % by weight unless otherwise specified.

Example 1

Preparation of Toner A

Figure 1B:
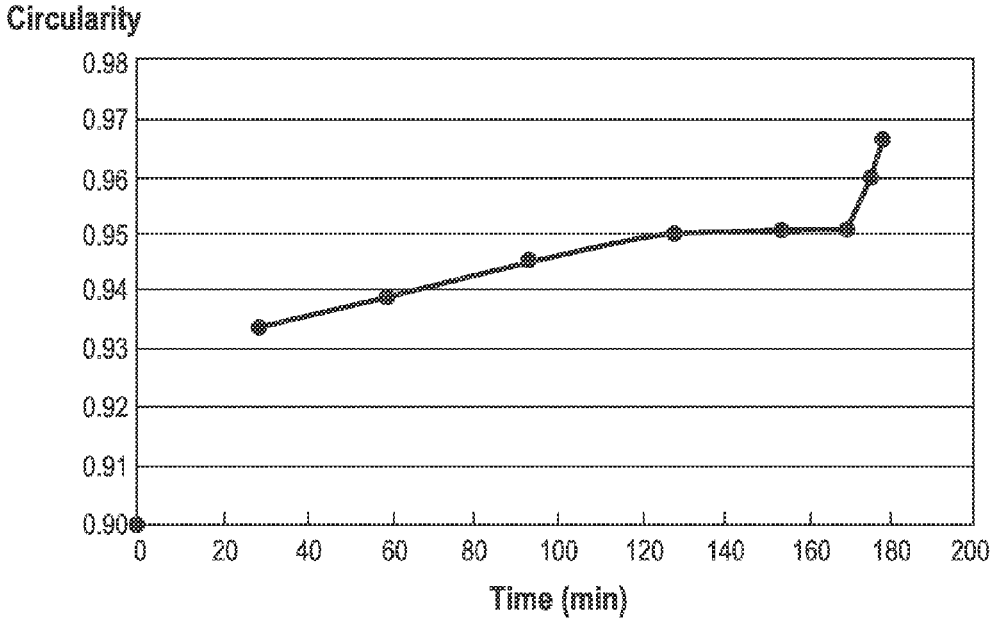
FIG. 1B is a graph illustrating the change of circularity of the aggregated particles during a coalescence process in accordance with an embodiment of the disclosure.

This example illustrates a coalescence process according to one of the present embodiments, where the pH was adjusted to increase from the freezing aggregation pH to the first pH and then adjusted to decrease from the first pH to the second pH. Into a 2 liter glass reactor equipped with an overhead mixer was added 274.05 g emulsion of Bio based resin A (20.35 wt %), 21.43 g crystalline resin emulsion (35.60 wt %), 33.86 g IGI wax dispersion (29.97 wt %) and 38.79 g cyan pigment PB15:3 (17 wt %). Separately, 1.97 g $Al_2(SO_4)_3$ (27.85 wt %) was added in as the flocculent under homogenization. The mixture was heated to about 37.7° C. to aggregate the particles while stirring at 300 rpm. The particle size was monitored with a Coulter Counter until the core particles reached a volume average particle size of 4.63 um with a GSD volume of 1.21. Subsequently, 151.35 g of the above mentioned Bio based resin A emulsion was added as shell material, resulting in a core-shell structured particles with an average particle size of 5.54 microns with a GSD volume of 1.19. Thereafter, the pH of the reaction slurry was increased to 7.8 using 4 wt % NaOH solution followed by 4.23 g EDTA (39 wt %) to freeze the toner growth. After freezing, the reaction mixture was heated to 75° C., while maintaining the pH at 7.8. Once temperature reached 75° C., the pH was further increased to 9.6 to delay and slow down toner spheridization, and then followed by reducing pH to 8.4 when approaching 3 hours of coalescence. FIG. 1A shows the change of pH over time of coalescence and FIG. 1B shows the change of circularity over time of coalescence. The toner was quenched after coalescence, resulting in a final particle size of 6.21 microns (within the desired range of 0.960 to 0.968), GSD volume of 1.23, GSD number 1.25, and circularity 0.966. The toner slurry was then cooled to room temperature, separated by sieving (25 mm), filtration, followed by washing and freeze dried. The above process is difficult for toner circularity control. The process was then optimized to increase the pH after desired circularity is achieved to stop further particle spheridizing, which is described in the toner preparation Example 2 below.

Example 2

Preparation of Toner B

Figure 2:
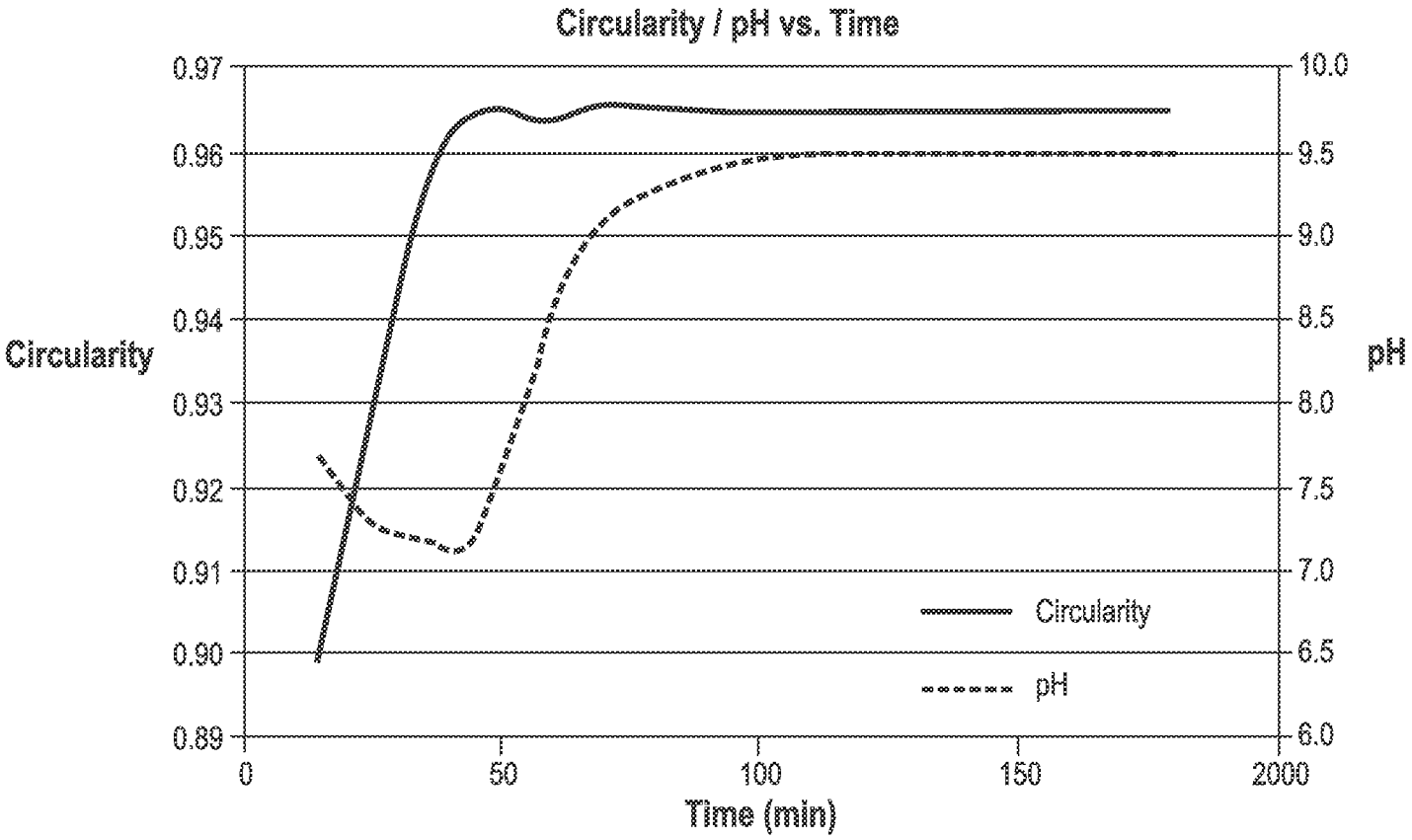
FIG. 2 is a graph illustrating the change of pH and circularity of the aggregated particles during a coalescence process in accordance with an embodiment of the disclosure.

This example illustrates a coalescence process according to one of the present embodiments, where the pH was adjusted to decrease from the freezing aggregation pH to the second pH and then adjusted to increase from the second pH to the first pH. Into a 2 liter glass reactor equipped with an overhead mixer was added 319.71 g emulsion of bio based resin B (19.04 wt %) prepared by the standard PIE process, 23.33 g crystalline resin emulsion (35.70 wt %), 37.02 g IGI wax dispersion (29.90 wt %) and 48.09 g cyan pigment PB15:3 (14.96 wt %). Separately, 2.15 g $Al_2(SO_4)_3$ (27.85 wt %) was added in as the flocculent under homogenization. The mixture was heated to about 37.7° C. to aggregate the particles while stirring at 300 rpm. The particle size was monitored with a Coulter Counter until the core particles reached a volume average particle size of 4.63 um with a GSD volume of 1.21. Subsequently, 151.35 g of the above mentioned Bio based resin B was added as shell material, resulting in a core-shell structured particles with an average particle size of 5.54 microns with a GSD volume of 1.19. Thereafter, the pH of the reaction slurry was then increased to 7.8 using 4 wt % NaOH solution followed by 4.23 g EDTA (39 wt %) to freeze the toner growth. After freezing, the reaction mixture was heated to 75° C., while maintaining the pH at 7.8. Once temperature reached 75° C., the pH was decreased to 7.1 followed by increasing pH to 9.5 when approaching 3 hours of coalescence. FIG. 2 shows the change of pH and circularity over time of coalescence. The toner was quenched after coalescence, resulting in a final particle size of 5.71 microns, GSD volume of 1.22, GSD number 1.28, and circularity 0.957. The toner slurry was then cooled to room temperature, separated by sieving (25 mm), filtration, followed by washing and freeze dried.

Example 3

Preparation of Toner C

This example illustrates a coalescence process according to one of the present embodiments, where the pH was adjusted to increase from the freezing aggregation pH to the first pH.

Figure 3:
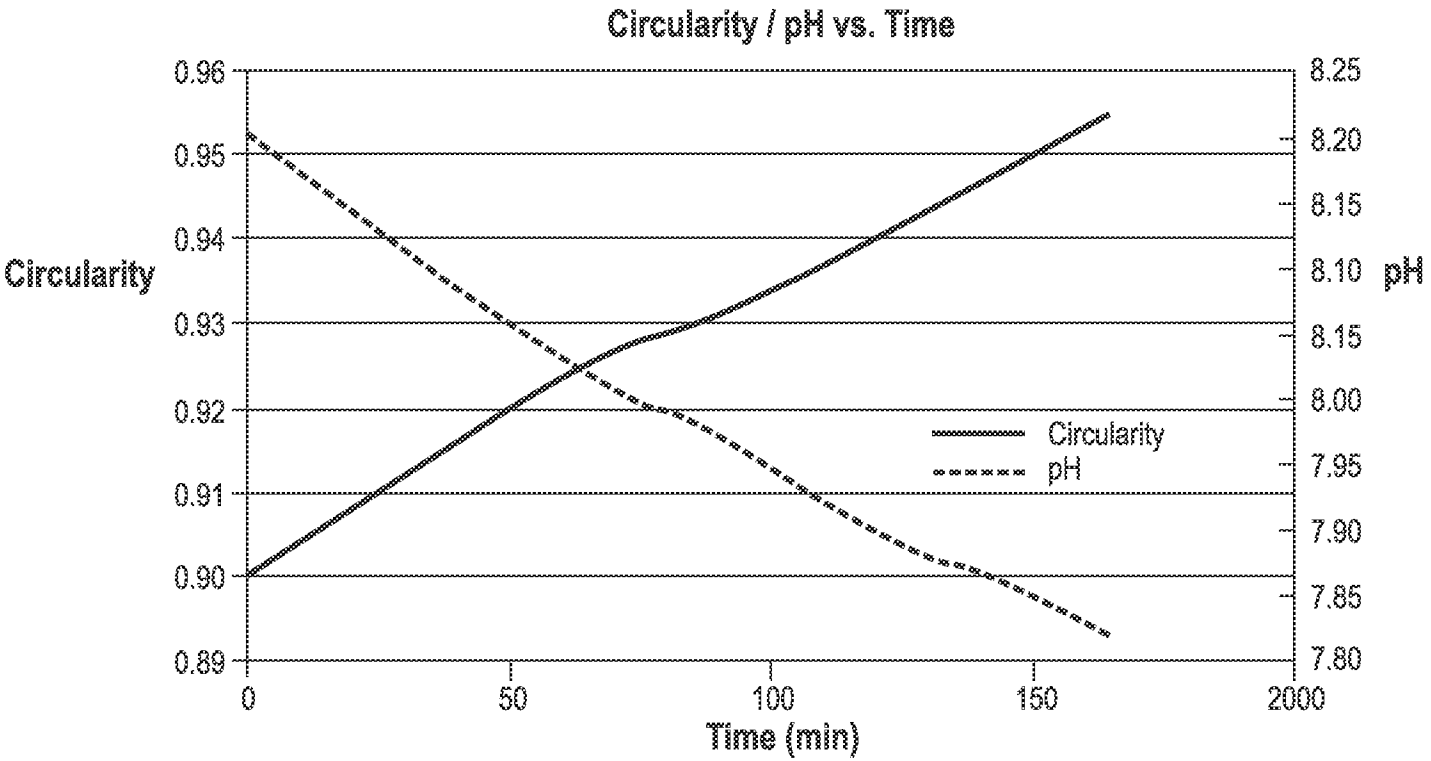
FIG. 3 is a graph illustrating the change of pH and circularity of the aggregated particles during a coalescence process in accordance with an embodiment of the disclosure.

Into a 20 gallon stainless steel reactor equipped with an overhead mixer was added 13.52 Kg emulsion of bio based resin C (37.50 wt %) prepared by standard PIE process, 1.969 Kg crystalline resin emulsion (35.22 wt %), 3.07 Kg IGI wax dispersion (35.05 wt %) and 3.633 Kg cyan pigment PB15:3 (16.5 wt %). Separately, 108 g $Al_2(SO_4)_3$ (27.85 wt %) was added in as the flocculent under homogenization. The mixture was heated to about 40° C. to aggregate the particles while stirring at 330 rpm. The particle size was monitored with a Coulter Counter until the core particles reached a volume average particle size of 4.68 um with a GSD volume of 1.23. Subsequently, 7.47 kg of above mentioned Bio based resin C emulsion was added as shell material, resulting in a core-shell structured particles with an average particle size of 6.02 microns with a GSD volume of 1.25. Thereafter, the pH of the reaction slurry was then increased to 7.8 using 4 wt % NaOH solution followed by 385 g EDTA (39 wt %) to freeze the toner growth. After freezing, the reaction mixture was heated to 75° C., while maintaining the pH at 7.8. Once temperature reached 75° C., the pH was increased to 8.2 to slow down coalescence. At the end of the coalescence time (3 hours), pH drifted on its own to 7.8 the average circularity of the toner particles is measured to be within the desired range of 0.960 to 0.968. Therefore, no further adjustment of pH was needed during the three hour of coalescence. FIG. 3 shows the change of pH and circularity over time of coalescence. The toner was quenched after coalescence, resulting in a final particle size of microns, GSD volume of 1.22, GSD number 1.25, and circularity 0.962.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for preparing a toner, comprising:

aggregating a mixture comprising a bio-based resin and an optional wax to form aggregated particles;

freezing aggregation of particles by adjusting the pH of the aggregated particles to a freezing aggregation pH of from about 5 to about 9;

coalescing the aggregated particles to form toner particles at a second pH of from about 6.5 to about 8 and subsequently increasing the pH to a first pH of from 8 to 13, wherein the first pH is from about 0.2 pH unit to about 2 units higher than the freezing aggregation pH; and recovering the toner particles;

wherein the average circularity of the toner particles is from about 0.940 to about 0.990.

2. The method of claim 1, wherein the first pH is from about 0.2 pH unit to about 5 pH units higher than the freezing aggregation pH.

3. The method of claim 1, wherein the second pH is from about 0.1 pH unit to about 5 pH units lower than the first pH.

4. The method of claim 1, wherein the second pH is higher than the freezing aggregation pH.

5. The method of claim 1, wherein the second pH is lower than the freezing aggregation pH.

6. The method of claim 1, wherein the coalescing step is conducted at a temperature of from about 60° C. to about 99° C.

7. The method of claim 1, wherein the bio-based resin having a glass transition temperature of from about 30° C. to about 80° C.

8. The method of claim 1, wherein the bio-based polyester resin is present in an amount of from about 10 to about 95 percent by weight of the toner.

9. The method of claim 1, wherein the mixture further comprises a crystalline resin.

10. The method of claim 1, wherein the toner particles have an average size of from about 3 microns to about 10 microns.

11. The method of claim 1, wherein the coalescing step is performed for a period of time of from 1 minute to 10 hours.

* * * * *